US005256127A

United States Patent [19]

Yeh

[11] Patent Number: 5,256,127

[45] Date of Patent: Oct. 26, 1993

[54] AMUSEMENT TWISTER EQUIPPED WITH SOUND REPRODUCER

[76] Inventor: Peter Yeh, 6th. Floor, No. 210, An Ho Rd., Taipei, Taiwan

[21] Appl. No.: 932,594

[22] Filed: Aug. 20, 1992

[51] Int. Cl.[5] ..... A63B 23/00

[52] U.S. Cl. ..... 482/146

[58] Field of Search ..... 482/146, 147, 900, 902; 434/253

[56] References Cited

U.S. PATENT DOCUMENTS

| | | | |
|---|---|---|---|
| 3,100,639 | 8/1963 | Bonewitz | 482/147 |
| 3,454,273 | 7/1969 | Voot | 482/147 |
| 4,109,909 | 8/1978 | Csutor | 482/146 |
| 4,291,873 | 9/1981 | Lee et al. | 482/147 |
| 4,840,372 | 6/1989 | Oglesby et al. | 482/902 X |

FOREIGN PATENT DOCUMENTS

| | | | |
|---|---|---|---|
| 425573 | 5/1967 | Switzerland | 402/147 |

*Primary Examiner*—Richard J. Apley
*Assistant Examiner*—Glenn E. Richman
*Attorney, Agent, or Firm*—Browdy and Neimark

[57] ABSTRACT

An amusement twister has a base disk provided at the center thereof with a hollow axle, a locking disk provided at the center thereof with a round hole dimensioned to fit over the hollow axle of the base disk, and a rotation disk provided at the center of the underside thereof with an engaging rod dimensioned to fit into the hollow portion of the hollow axle in such a manner that the underside of the rotation disk presses the steel balls received partially in the slots located in the upper surface of the locking disk, so as to permit the rotation disk to be turned leftwards and rightwards for a short span in a reciprocating pattern by the user's feet standing on the rotation disk, which is further provided with a protruded portion serving as a baffle and containing therein a receiving space for housing a speaker, a sound-reproducing circuit board, a plurality of batteries, and a switch. A musical note or an exercise command stored programmably in the integrated circuit is reproduced, when the user of the amusement twister is doing an exercise on the twister.

1 Claim, 2 Drawing Sheets

AMUSEMENT TWISTER EQUIPPED WITH SOUND REPRODUCER

FIELD OF THE INVENTION

The present invention relates to an equipment for sport and amusement, and more particularly to an amusement twister having a sound reproducing means mounted therein.

BACKGROUND OF THE INVENTION

The people are now increasingly interested in making a sports equipment a fun thing to play with. This is particularly true with the youngsters, who are easily bored with a monotonous sports equipment. A case in point is a twister provided with a deck, on which a player stands with his or her two feet, and with a means to rotate leftwards and rightwards for a short span in a reciprocating manner. The conventional sports equipment, such as the twister mentioned above, is often defective in design in that it fails to draw the attention of a youngster to take interest in playing with it.

SUMMARY OF THE INVENTION

It is, therefore, the primary objective of the present invention to provide an amusement twister with a means capable of reproducing a musical note or an exercise command serving to encourage the youngsters to take interest in using the amusement twister.

It is another objective to the present invention to provide an amusement twister, which is light in weight and small in size for an easy transportation thereof.

In keeping with the principles of the present invention, the foregoing objectives of the present invention are accomplished by an amusement twister, which comprises a base disk provided at the center thereof with a hollow axle, a locking disk provided at the center thereof with a round hole dimensioned to fit over the hollow axle of the base disk, and a rotation disk provided at the center of the underside with an engaging rod dimensioned to fit into the circular hole of the hollow axle of the base disk in such a manner that the underside of the rotation disk presses the steel balls received partially in the slots located in the upper surface of the locking disk, so as to permit the rotation disk to be turned leftwards and rightwards for a short span in a reciprocating pattern by the user's two feet standing on the rotation disk. The amusement twister is characterized in that its rotation disk is provided with a protruded portion having a receiving space intended to house a speaker, a sound-controlling circuit board, a plurality of batteries, and a switch. Therefore, a rotating action of the rotation disk activates the process of reproducing a musical tune or an exercise command.

The foregoing objectives, features and functions of the present invention will be better understood by studying the following detailed description of a preferred embodiment of the present invention, in conjunction with the drawings provided herewith.

DETAILED DESCRIPTION OF THE PREFERRED EMBODIMENT

Figure 1:
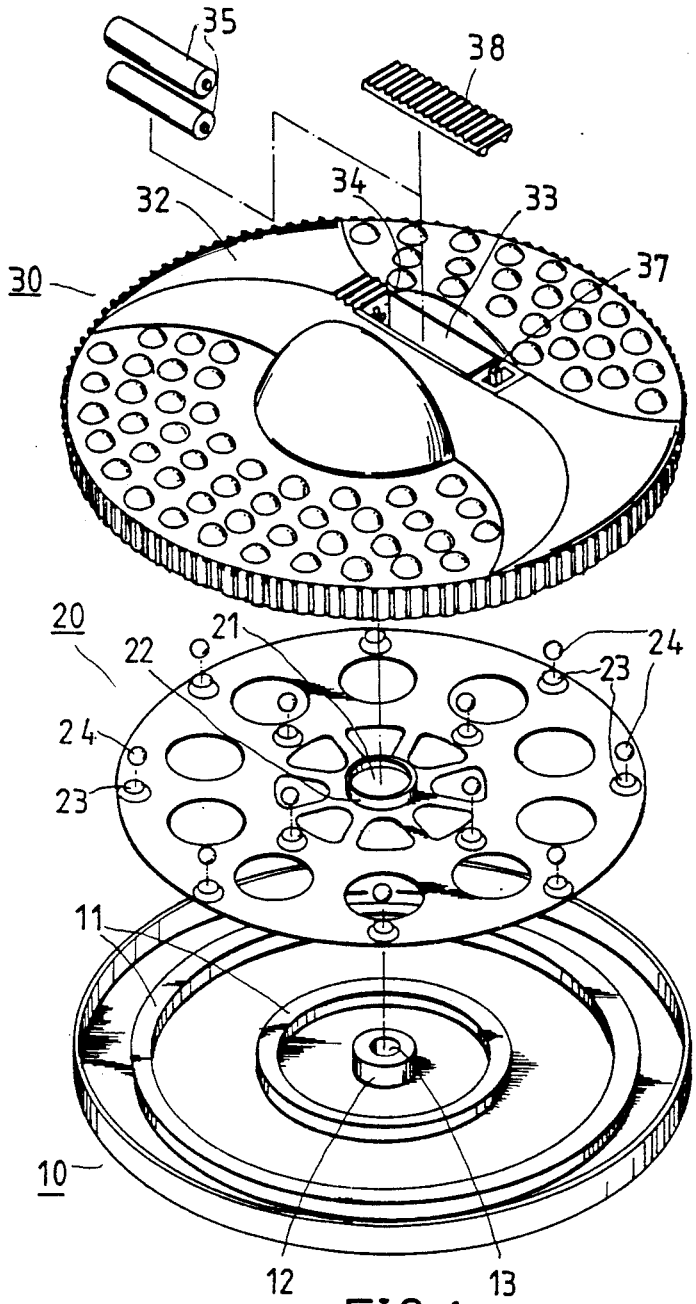
FIG. 1 shows an exploded view of an amusement twister embodied in the present invention.
Figure 3:
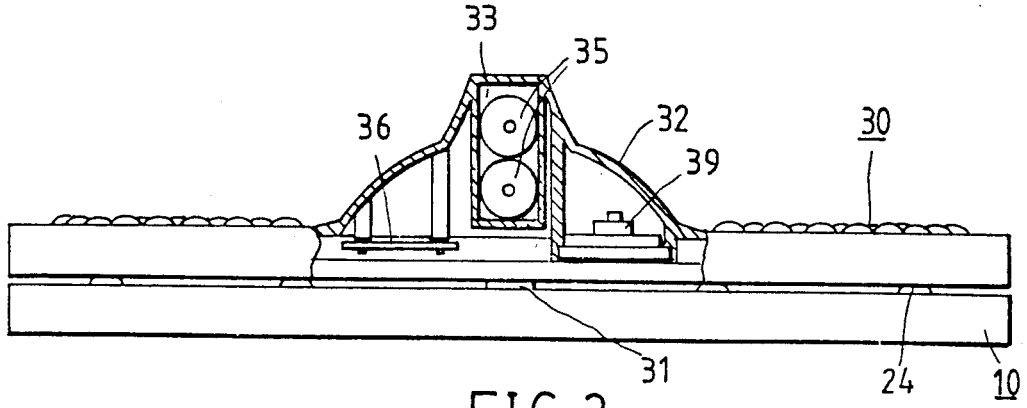
FIG. 3 is an enlarged sectional view of a portion taken along the line 3—3 as shown in FIG. 2.
Figure 2:
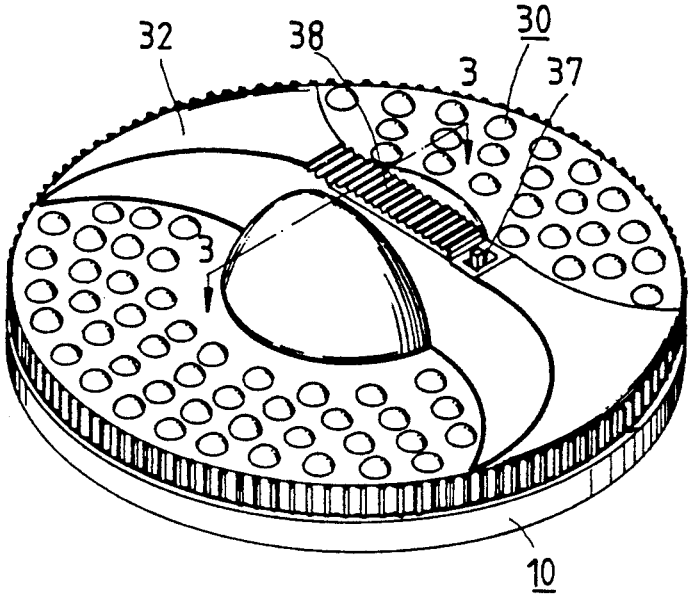
FIG. 2 shows a perspective view of the amusement twister in combination according to the present invention.

Referring to FIGS. 1-3, an amusement twister of the present invention is shown to comprise a base disk 10, a locking disk 20, and a rotation disk 30.

The base disk 10 is made of a plastic material by injection molding and is provided with two protruded rings 11 and a hollow axle 12 located at the center thereof. The hollow axle 12 has a circular hole 13 and a height greater than the height of the protruded rings 11.

The locking disk 20 is provided at the center thereof with a round hole 21 having a brace 22 extending upwards. The round hole 21 is so dimensioned as to permit the hollow axle 12 of the base disk 10 to pass through, with the brace 22 fitting over the hollow axle 12. The underside of the locking disk 20 is supported by the two protruded rings 11 of the base disk 10. The top surface of the locking disk 20 is provided with a plurality of slots 23, each of which is dimensioned to receive partially a steel ball 24.

Figure 4:
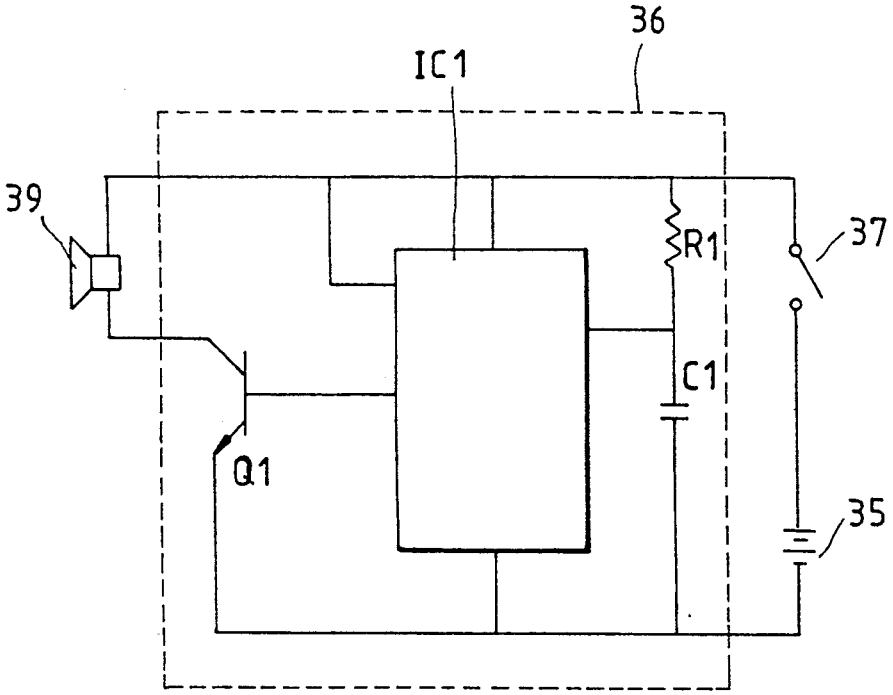
FIG. 4 shows a sound-controlling circuitry of the present invention.

The rotation disk 30 is provided at the center of the underside thereof with an engaging rod 31 dimensioned to fit into the circular hole 13 of the base disk 10 in such a way that the underside of the rotation disk 30 presses against the steel balls 24 received in the slots 23 of the locking disk 20. Therefore, the rotation disk 30 is capable of turning by virtue of the rolling friction between the steel balls 24 and the underside of the rotation disk 30. In addition, the top surface of the rotation disk 30 is furnished with a protruded portion 32 serving as a baffle between the user's feet standing on the rotation disk 30. The protruded portion 32 contains therein a receiving space 33 intended to house a plurality of battery conductive pieces 34, two batteries 35, a speaker 39, a sound-controlling circuit board 36, and a switch 37. The receiving space 33 is protected by a cap 38. The circuitry of the sound-controlling circuit board 36, as shown in FIG. 4, is provided with an integrated circuit (IC1) capable of storing programmably musical notes or exercise commands. The stored musical tunes or exercise commands are reproduced through the speaker 39 in cooperation with a resistor (R1), a capacitor (C1), and a transistor (Q1), when the switch 37 is turned on.

The amusement twister of the present invention has the following advantages.

The protruded portion 32 of the rotation disk 30 serves as a baffle between the exerciser's feet, so as to enable the exerciser to control easily the moment of inertia. For example, when the rotation disk 30 is turned rightwards to generate a clock-wise moment of inertia, the exerciser may use his or her right foot to exert a pressure on the right side of the baffle so as to mitigate the clock-wise moment of inertia.

The amusement twister of the present invention is a fun thing to play with, because it is provided with a sound-reproducing means capable of reproducing a musical tune or an exercise command, which is stored programmably in an integrated circuit.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the hereinafter appended claim.

What is claimed is:

1. An amusement twister equipped with a sound reproducer comprising:

a base disk with a hollow axle located at the center thereof and provided centrally with a circular hole;

said base disk having support rings concentric with said hollow axle;

a locking disk provided at the center thereof with a round hole dimensioned to permit said hollow axle to pass therethrough and with a plurality of slots located in the top surface thereof;

a steel ball bearing rotatably and correspondingly engaged in each of said plurality of slots;

a bottom surface of said locking disk mounted on said support rings when said hollow axle is engaged through said circular hole of said base disk;

a rotation disk having an underside with an engaging rod extending therefrom at the center thereof;

said underside mounted on each said steel ball bearing when said engaging rod is engaged in said circular hole of said base disk; and said rotation disk having a protruded portion serving as a baffle and having therein a receiving space housing therein a speaker, sound-controlling circuit board means for storing and playing music or exercise commands on said speaker, a plurality of batteries, and a switch;

said receiving space sealed with a cap.

* * * * *